US006373008B1

(12) United States Patent
Saito et al.

(10) Patent No.: US 6,373,008 B1
(45) Date of Patent: Apr. 16, 2002

(54) LIGHT ILLUMINATING TYPE SWITCH

(75) Inventors: Atsushi Saito, Tokyo; Yasufumi Naoi, Narashino; Koji Yoneda, Ichikawa; Kaori Aoki, Funabashi, all of (JP)

(73) Assignee: Seiko Precision, Inc., Chiba-ken (JP)

( * ) Notice: Subject to any disclaimer, the term of this patent is extended or adjusted under 35 U.S.C. 154(b) by 0 days.

(21) Appl. No.: 09/522,084

(22) Filed: Mar. 10, 2000

(30) Foreign Application Priority Data

Mar. 12, 1999 (JP) ..... 11-067095
May 20, 1999 (JP) ..... 11-140742
Jan. 21, 2000 (JP) ..... 12-013076

(51) Int. Cl.[7] ..... H01H 9/18
(52) U.S. Cl. ..... 200/310; 200/512; 200/517; 200/314; 200/317
(58) Field of Search ..... 200/5 A, 512–517, 200/310–317, 341, 345

(56) References Cited

U.S. PATENT DOCUMENTS 4,532,395 A * 7/1985 Zukowski ..... 200/314
5,797,482 A * 8/1998 LaPointe et al. ..... 200/314
5,871,088 A * 2/1999 Tanabe ..... 200/514
5,901,834 A * 5/1999 Inubushi et al. ..... 200/314
5,924,555 A * 7/1999 Sadamori et al. ..... 200/512
5,950,808 A * 9/1999 Tanabe et al. ..... 200/314
5,986,228 A * 11/1999 Okamoto et al. ..... 200/516

* cited by examiner

*Primary Examiner*—Michael Friedhofer
(74) *Attorney, Agent, or Firm*—Schulte Roth & Zabel LLP; Donna L. Angotti; Joel Lutzker

(57) ABSTRACT

A unitized light illuminating type switch in a thinned type and having enhanced click feeling. A movable contact and an electroluminescent sheet are formed in an integrated structure by attachedly pasting together the movable contact and the electroluminescent sheet. Fixed contacts are provided on a switch sheet. A movable contact capable of electrically connecting to the switch sheet by being elastically deformed is arranged above the switch sheet. A flexible electroluminescent sheet A is attachedly pasted to a surface of the movable contact by interposing an insulating member as far as a peripheral portion of the movable contact other than the movable contact.

13 Claims, 8 Drawing Sheets

OF: Operating Force

RF: Return Force

CK: [(OF−RF)/OF]×100 [%]

LIGHT ILLUMINATING TYPE SWITCH

BACKGROUND OF THE INVENTION

1. Field of the Invention

The present invention relates generally to a light illuminating type switch and, more particularly, to a switch illuminating light by an electroluminescent sheet.

2. Description of the Related Art

A conventional light illuminating type switch in which an electroluminescent sheet of a type not integrated to a movable contact is provided on the movable contact electrically connected to a fixed contact provided on a switch sheet by being elastically deformed to thereby illuminate the switch is described in Japanese Patent Laid-Open No. 144172, published in 1998.

When an electroluminescent sheet is not used as a light source for illuminating light, as shown in FIG. 15, a light emitting diode (LED) 102 is arranged above a switch sheet 101, and illuminated light from LED 102 is diverged via a key operating pad 103 to thereby illuminate the entire switch.

According to the conventional light illuminating type switch for illuminating light by the electroluminescent sheet by using the movable contact, the electroluminescent sheet and the movable contact are not integrated with each other and, therefore, unitization of the light illuminating type switch is incomplete. That is, the light illuminating type switch is constituted merely by providing the electroluminescent sheet above a conventional switch. Therefore, also in view of integration steps, later steps undergo load of integration.

Further, according to the light illuminating type switch using an LED, the LED per se constitutes a point light source and, accordingly, the entire surface of the switch cannot easily be uniformly illuminated. The entire surface of the switch can be uniformly illuminated by using a key operating pad made of a material comprising, for example, silicone rubber dispersed with white pigment. The key operating pad diverges the light illuminated by the LED. However, in this case, a satisfactory result cannot be attained in uniformly illuminating the entire surface of the switch by using a key operating pad having a thin thickness. In practice, a key operating pad having a thickness of 2.5 through 3.0 mm is used, which hampers formation of a thin light illuminating type switch.

There is, therefore, a need in the art for a light illuminating type switch with a thin construction that is suitable for use in thin and light-weight apparatus, such as a portable telephone or a personal digital assistant. There is further a need in the art for such a switch to possess excellent clicking performance in ON/OFF operation of the switch.

SUMMARY OF THE INVENTION

The present invention is directed to an apparatus that satisfies the need for a light illuminating type switch that has a thin construction and that possesses excellent clicking performance in ON/OFF operation of the switch.

According to the embodiments of the present invention, a movable contact and an electroluminescent sheet are constructed in an integrated and thin structure by attachedly pasting together the movable contact and the electroluminescent sheet to thereby enable to supply a light illuminating type switch at the stage. Further, a method of adhering the electroluminescent sheet to the movable contact to conform the electroluminescent sheet to the shape of the movable contact provides a switch having excellent click feeling.

According to an embodiment of the present invention, a light illuminating type switch comprises: fixed contacts provided on a switch sheet; a movable contact capable of electrically connecting to the switch sheet by being deformed elastically arranged above the switch sheet; and a flexible electroluminescent sheet is attachedly pasted on a surface of the movable contact by interposing an insulating member as far as a peripheral portion thereof other than the movable contact.

In a preferred embodiment, the electroluminescent sheet and the movable contact may be attachedly pasted together by an adhesive material interposed between the electroluminescent sheet and the surface of the movable contact. The adhesive material may be interposed between the electroluminescent sheet and only a portion of the surface of the movable contact to thereby attachedly paste together the electroluminescent sheet and the movable contact.

In a further preferred embodiment, the electroluminescent sheet and the movable contact may be attachedly pasted together by a sheet with a double-sided adhesive material interposed between the electroluminescent sheet and the surface of the movable contact. The sheet with the double-sided adhesive material may be interposed between the electroluminescent sheet and only a portion of the surface of the movable contact to thereby attachedly paste together the electroluminescent sheet and the movable contact.

In a preferred embodiment, the movable contact may be a metal member formed in a dome shape. The metal member formed in the dome shape may be formed in a net-like shape.

In a further preferred embodiment, the electroluminescent sheet and the movable contact may be attachedly pasted together by the adhesive material or the sheet with the double-sided adhesive material interposed between the electroluminescent sheet and the surface of the movable contact, and the adhesive material or the sheet with the double-sided adhesive material may be interposed between the electroluminescent sheet and approximately 80% or less of an arc-like portion of the surface of the movable contact.

The electroluminescent sheet may be pre-molded or plastically deformed to constitute a shape that conforms to the shape of the movable contact. The electroluminescent sheet may be formed by successively laminating a transparent electrode layer, a luminescent layer, an insulating layer, and a rear electrode layer on a flexible transparent film, and at least one layer of the luminescent layer, the insulating layer and the rear electrode layer may be omitted at a portion of the electroluminescent sheet disposed above a surface portion of the movable contact.

In a preferred embodiment, a key operating pad is arranged above the electroluminescent sheet. In a further preferred embodiment, the key operating pad is formed in a sheet-like shape.

The above, and other features, aspects, and advantages of the present invention will become apparent from the following description read in conjunction with the accompanying drawings, in which like reference numerals designate the same elements.

BRIEF DESCRIPTION OF THE DRAWINGS

FIGS. 8A and 8B are views showing a dome type switch used in the invention in which FIG. 8A is a sectional view and FIG. 8B is a plane view;

FIGS. 9A and 9B are views showing an example in which an arc-like portion of the dome type switch is formed in a net-like shape in which FIG. 9A is a sectional view and FIG. 9B is a plane view;

FIGS. 10A and 10B are views showing an example of a shape of the dome type switch both ends of which are cut in which FIG. 10A is a sectional view and FIG. 10B is a plane view;

FIGS. 11A and 11B are views showing an example of a shape of the dome type switch the arc-like portion of which is formed in the net-like shape and the both ends of which are cut in which FIG. 11A is a sectional view and FIG. 11B is a plane view;

DETAILED DESCRIPTION OF THE PREFERRED EMBODIMENTS

Figure 1:
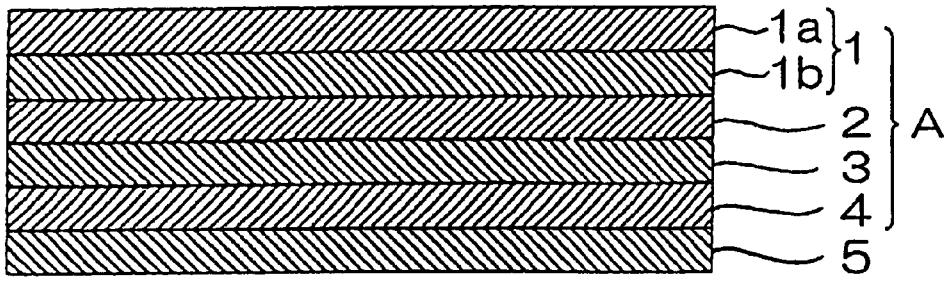
FIG. 1 is a sectional view showing a basic structure of an electroluminescent sheet used in an embodiment of the invention.

An explanation will be given of embodiments of the present invention in reference to the drawings. An explanation will be given of an electroluminescent sheet A used in the invention in reference to FIG. 1. A transparent electrode layer 1 is constituted by vapor-depositing indium tin oxide (hereinafter, referred to as "ITO") constituting a transparent electrode film 1*b* on a film 1*a* of polyethylene terephthalate. In the embodiment of FIG. 1, the thickness of film 1 is 75 μm.

A luminescent layer 2 is formed by printing luminescent ink on a surface of the transparent electrode layer 1. As a luminescent body for constituting the luminescent ink, there is used zinc sulfide (ZnS) doped with copper. As a binder of the luminescent body, there is used fluororesin binder produced by dissolving copolymer of vinyliden fluoride and propylene hexafluoride in methyl ethyl ketone as solvent and these are mixed and stirred to thereby produce the luminescent ink. The luminescent ink is printed on the ITO-deposited face by a method of screen printing process and, thereafter, heated and dried to thereby form the luminescent layer 2.

Next, an insulating layer 3 is formed by a method similar to the method of forming the luminescent layer 2 on the upper face of the transparent electrode layer 1. Insulating ink for forming the insulating layer 3 is produced by mixing and stirring a substance having a high inductive coefficient comprising barium titanate ($BaTiO_3$) and the above-described fluororesin binder.

Carbon ink is printed on the insulating layer 3 and is heated and dried to thereby form a rear electrode layer 4. Carbon ink is constituted by mixing carbon powder with polyester as a binder. Otherwise, the rear electrode layer 4 may be constituted by carbon powder, silver powder and copper powder and polyester as a binder.

By the above-described procedure, the electroluminescent sheet A is completed and according to an embodiment of the invention, an insulating layer 5 is formed on the rear electrode layer 4. The insulating layer 5 achieves electric insulation from a movable contact, described further herein, and may be used so far as the electric insulation can be established. The insulating layer 5 has nothing to do with the luminescence of the electroluminescent sheet A.

Figure 2:
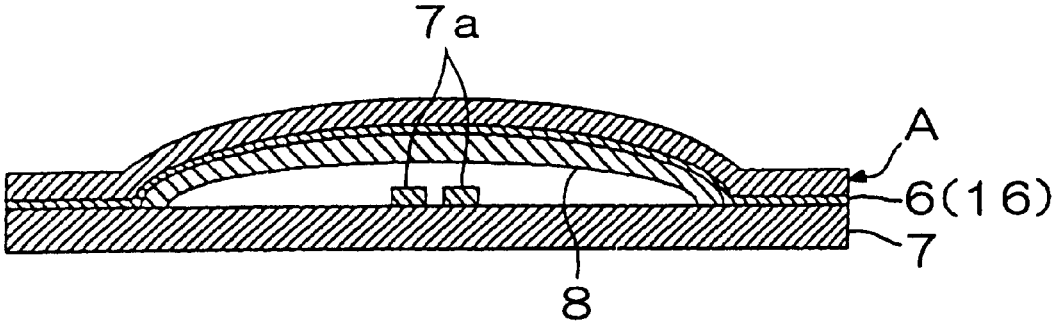
FIG. 2 is a sectional view showing a structure of a light illuminating type switch according to an embodiment of the invention.
Figure 9:
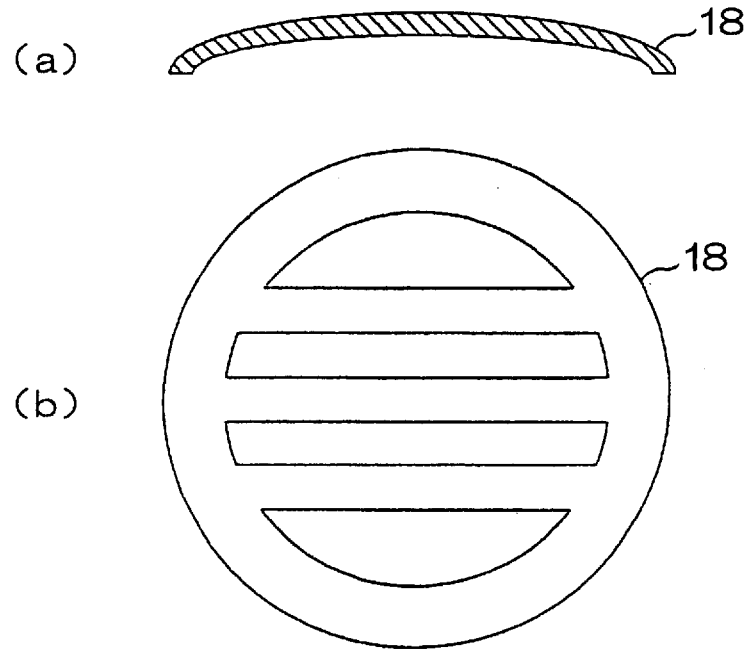
Figure 12:
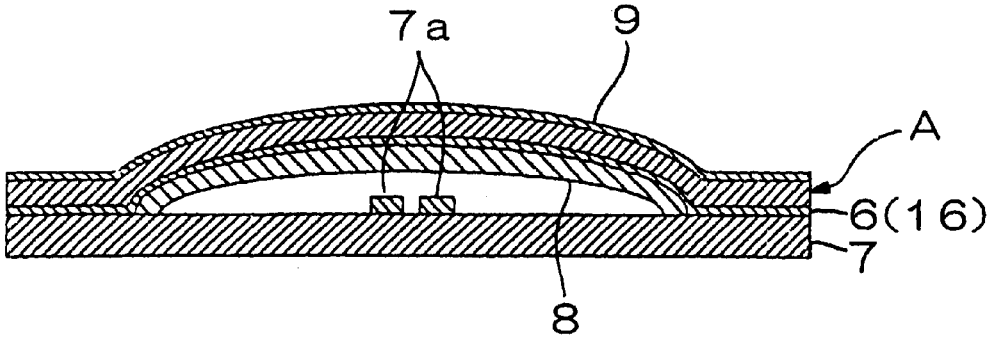
FIG. 12 is a sectional view showing an example in which characters or graphic figures are printed on a surface of an electroluminescent sheet used in a light illuminating type switch according to an embodiment of the invention.

Referring to FIG. 2, a switch sheet 7 is provided with a pair of fixed contacts 7*a* above which a movable contact 8 molded in a dome-like shape is arranged. The movable contact 8 is an elastically deformable member which is elastically deformed to recess by being depressed by the finger of a person, and recovers its original shape when the finger is removed. The movable contact 8 is accompanied by a pertinent click feeling when the movable contact 8 is depressed and when the movable contact 8 recovers to its original shape from the elastically deformed state. The movable contact 8 is brought into contact with the pair of fixed contacts 7*a* of the switch sheet 7 when it is elastically deformed to recess to thereby electrically couple the movable contact 8 to the fixed contacts 7*a*. That is, the movable contact 8 can be formed from, for example, a metal material having conductivity. An adhesive material 6 is coated on a surface of the electroluminescent sheet A, mentioned above, to thereby attachedly paste the movable contact 8 to the electroluminescent sheet A. Therefore, according to an embodiment of the present invention, the movable contact 8 and the electroluminescent sheet A constitute an integrated structure by interposing the insulating layer 5 between them. As shown in FIG. 12, the electroluminescent sheet A can be printed with, for example, characters or graphic FIG. 9 on its surface. Further, the movable contact 8 may be formed from not only a metal material but also an elastically deformable conductive material, for example, rubber mixed with carbon.

Further, according to the embodiment shown in FIG. 2, the electroluminescent sheet A is formed in a flat (i.e., not pre-molded or plastically deformed) shape and the electroluminescent sheet A and the movable contact 8 are attachedly pasted by the adhesive material 6 in a state in which the electroluminescent sheet A conforms to the shape of the movable contact 8. Further, the electroluminescent sheet A and the movable contact 8 may be attachedly pasted to one another not only by the adhesive material 6 but may be attachedly pasted by a sheet 16 attached with a double-sided adhesive material (referred to also as "double-sided adhesive tape").

Figure 3:
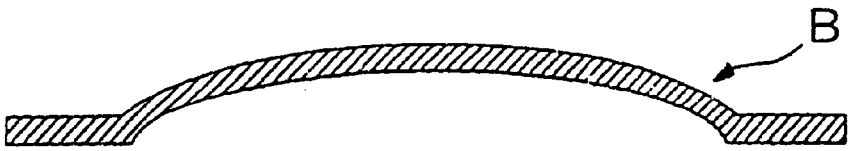
FIG. 3 is a sectional view of an electroluminescent sheet previously molded in a shape in line with a shape of a movable contact.

FIG. 3 shows an electroluminescent sheet B produced by pre-molding or plastically deforming a portion of the electroluminescent sheet in a shape that conforms to the shape of the movable contact 8. The constitution of the electroluminescent sheet B as a light illuminating type switch is similar to that shown in FIG. 2 and described above. In this way, the electroluminescent sheet B has previously been molded or plastically deformed with a shape that conforms to the shape of the movable contact 8 and, accordingly, when a light illuminating type switch is formed thereby a further excellent click feeling can be expected.

Figure 4:
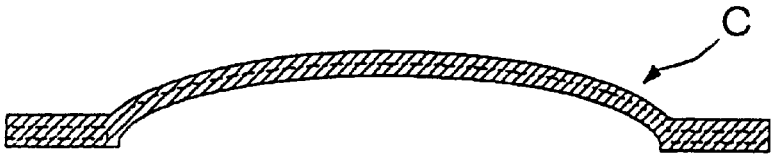
FIG. 4 is a sectional view of an electroluminescent sheet formed by omitting a luminescent layer, an insulating layer, and a rear electrode layer.

FIG. 4 shows an electroluminescent sheet C formed by omitting the luminescent layer 2, the insulating layer 3 and the rear electrode layer 4 in respect of a portion thereof overlapped with the movable contact 8 in a state of attachedly pasting the movable contact 8 to the electroluminescent sheet A or B. In this case, a light illuminating portion of a light illuminating type switch is constituted only by a surrounding of the movable contact 8. Here, although the electroluminescent sheet A or B is provided with a degree of flexibility, it is not preferable that the electroluminescent sheet undergoes repeated-elastic deformation. Therefore, when the electroluminescent sheet C shown in FIG. 4 is constructed, by repeatedly operating the light illuminating type switch ON and OFF, the repeated elastic deformation of the switch occurs at a portion of the electroluminescent sheet C that has no influence on light luminescence and, accordingly, the durability of the electroluminescent sheet is enhanced. Further, with regard to the portion of the electroluminescent sheet that overlaps with the movable contact 8, alternative embodiments that do not necessarily omit all of the luminescent layer 2, the insulating layer 3 and the rear electrode layer 4, but omit at least one of these layers, may be constructed.

Figure 5:
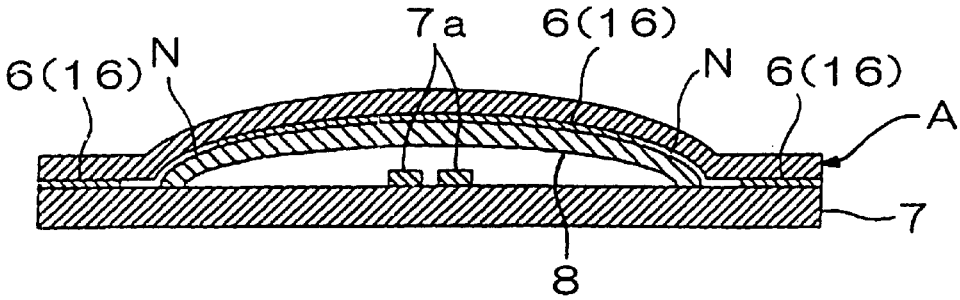
FIG. 5 is a sectional view showing an example of attachedly pasting together a movable contact and an electroluminescent sheet such that an adhesive material or a sheet attached with a double-sided adhesive material is interposed therebetween only at a portion of a surface of the movable contact.

FIG. 5 shows an embodiment of the present invention in which, in attachedly pasting the movable contact 8 to the electroluminescent sheet A, the adhesive material 6 is not coated over the entire surface of the movable contact 8, or the sheet 16 attached with the double-sided adhesive material is not interposed over the entire surface of the movable contact 8 as described above. Instead, the adhesive agent 6 or the sheet 16 attached with the double-sided adhesive material are respectively coated or interposed and attachedly pasted on the electroluminescent sheet A such that the electroluminescent sheet A is attachedly pasted only to one portion of the surface of the movable contact 8. In this case, there are portions in which the adhesive material 6 or the sheet 16 attached with the double-sided adhesive material is not interposed on the surface of the movable contact 8. Accordingly, although the movable contact 8 is attachedly pasted on the electroluminescent sheet A, non-adhering portions N are also present.

Figure 6:
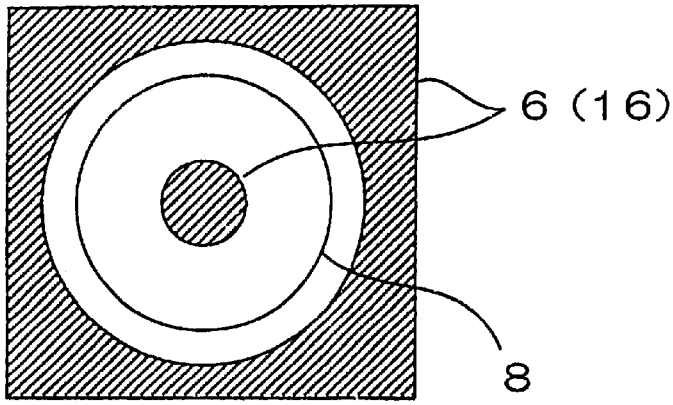
FIG. 6 is a plane view showing a region of the adhesive material or the sheet attached with the double-sided adhesive material interposed therebetween only at the portion of the surface of the movable contact.
Figure 7:
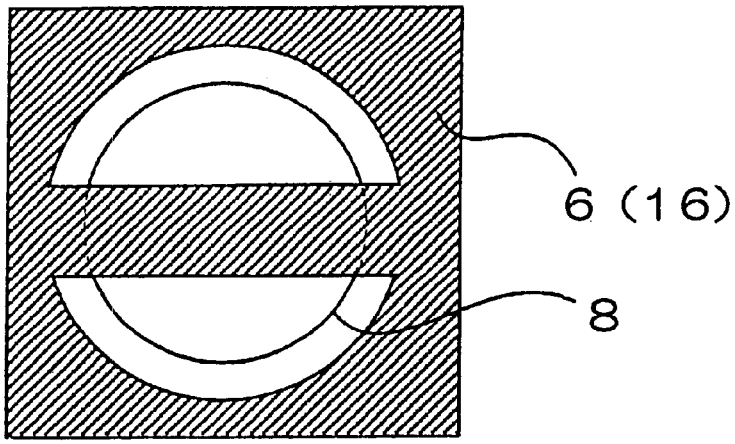
FIG. 7 is a plane view showing another region of the adhesive material or the sheet attached with the double-sided adhesive material interposed therebetween only at a portion of the surface of the movable contact.

FIG. 5 shows an embodiment in which the non-adhering portions N are interposed between the electroluminescent sheet A and the movable contact 8 only at the peripheral portions of the surface of the movable contact 8. However, the invention is not limited to this embodiment but also encompasses embodiments wherein the adhesive material 6 or the sheet 16 attached with the double-sided adhesive material is interposed only at a central portion of the movable contact 8, as shown in FIG. 6, and the adhesive material 6 or the sheet 16 attached with the double-sided adhesive material is interposed to constitute a bridge over the surface of the movable contact 8, as shown in FIG. 7.

An explanation of the dome type switch used in the embodiments as the movable contact 8 will be given with reference to FIGS. 8A and 8B. The movable contact 8 is made of a metal, a stainless steel or a phosphor bronze material, and can be deformed elastically. The movable contact is brought into a recessed state by being elastically deformed when depressed by, for example, the finger of a person, and recovers to its original shape when the finger is removed. The movable contact 8 is brought into contact with the pair of fixed contacts 7*a* when the movable contact 8 is elastically deformed to recess and the pair of fixed contacts 7*a* is electrically coupled to the movable contact 8.

There is a difference in the click feeling provided by the operation of the switch between the embodiment shown in FIG. 2, in which the adhesive material 6 or the sheet 16 attached with the double-sided adhesive material is interposed and the movable contact 8 is attachedly pasted to the electroluminescent sheet A such that the entire surface of the movable contact 8 is attachedly pasted thereto, and the embodiment shown in FIG. 5, in which the movable contact 8 is attachedly pasted to the electroluminescent sheet A such that the adhesive agent 6 or the sheet 16 attached with the double-sided adhesive material is interposed only at a portion of the surface of the movable contact 8. An explanation will be given of the results of a quantitative measurement of the difference.

Generally, the click feeling of the dome type switch of this kind is represented by a value calculated according to the following equation:

$$\text{Click rate } (\%) = 100 \times \frac{(OF\text{: Operating Force} - RF\text{: Return Force})}{(OF\text{: Operating Force})}.$$

Figure 16:
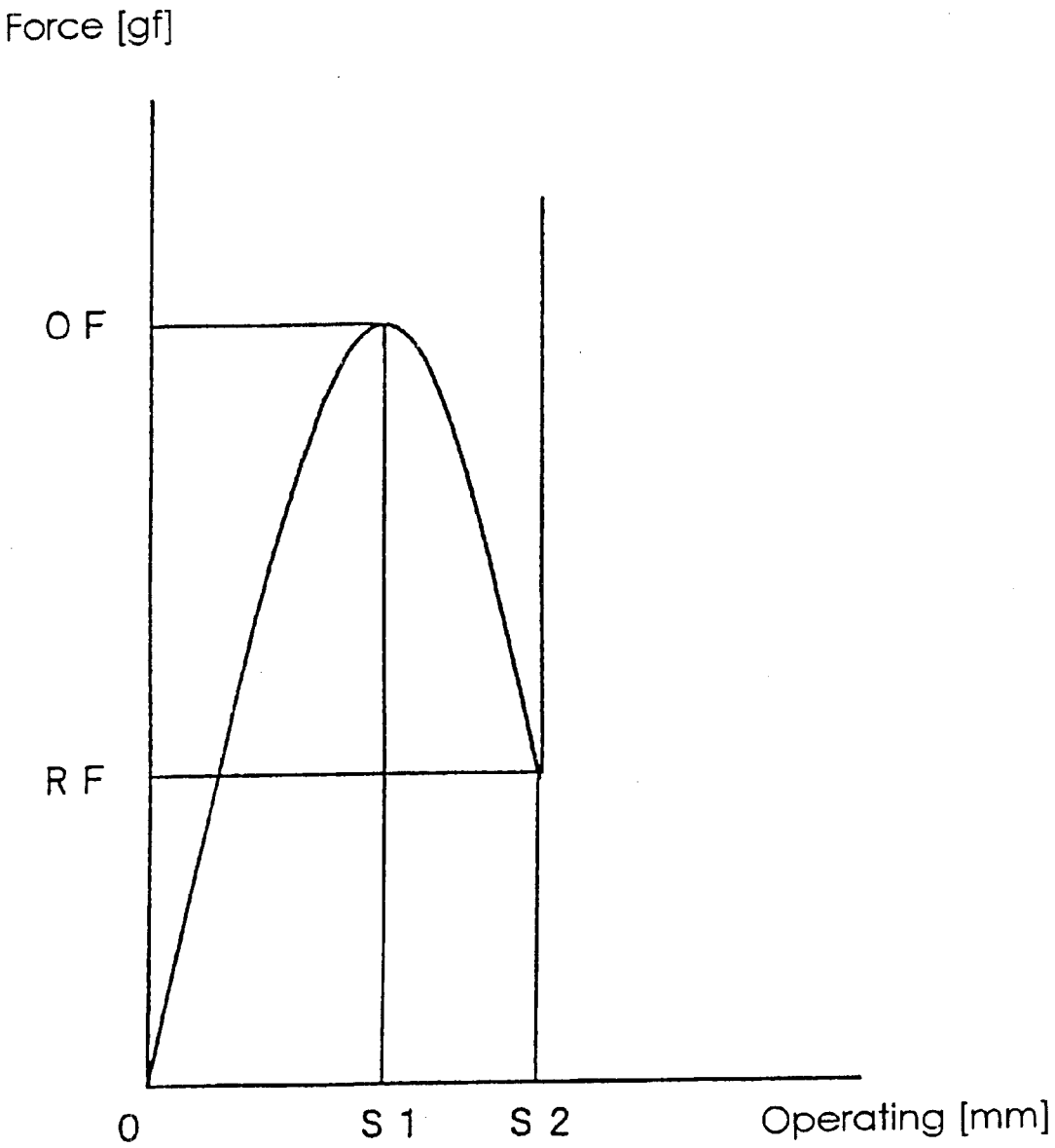
FIG. 16 is an explanatory view for explaining parameters used in calculating a click rate of a dome type switch.

In the above equation, "OF: Operating Force" designates a maximum value of force necessary to deform the dome type switch from its dome type shape to a shape for electrically connecting the movable contact to the pair of fixed contacts of the switch sheet("the pushed-in state"), and "RF: Return force" designates a value of force at the point in time at which the dome type switch reaches the shape at which the pair of fixed contacts of the switch sheet are electrically connected to the movable contact, as shown in FIG. 16. Further, the click rate is judged to be excellent when the result given by the above equation is 50%±10%. When the movable contact 8 shown by FIGS. 8A and 8B is used, the resulting click rates are 49%, 43% and 15% respectively for the following three embodiments: (1) a single member for the movable contact 8 (dome type switch); (2) the electroluminescent sheet A is attachedly pasted such that the adhesive material 6 or the sheet 16 attached with the double-sided adhesive material is interposed only at a portion of the surface of the movable contact 8; and (3) the adhesive material 6 is coated or the sheet 16 attached with the double-sided adhesive material is interposed to attachedly paste the movable contact 8 on the electroluminescent sheet A such that the entire surface of the movable contact 8 is attachedly pasted to the electroluminescent sheet A. That is, an excellent click feeling may be achieved for the embodiment in which the electroluminescent sheet A and the movable contact 8 are attachedly pasted together such that the adhesive material 6 or the sheet 16 attached with the double-sided adhesive material is interposed therebetween only at a portion of the surface of the movable contact 8.

Figure 8:
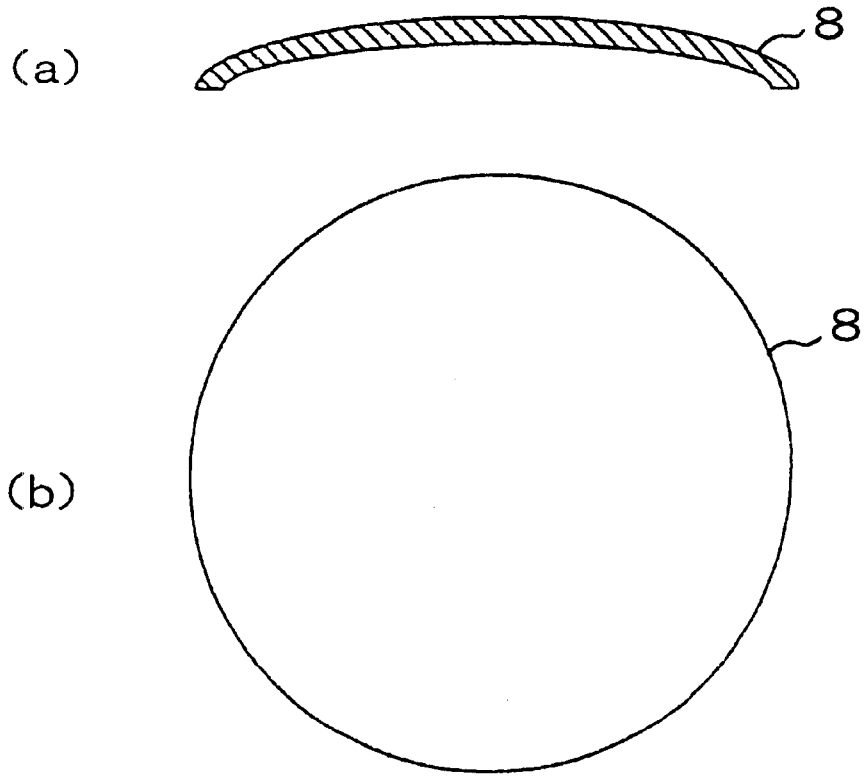
Figure 10:
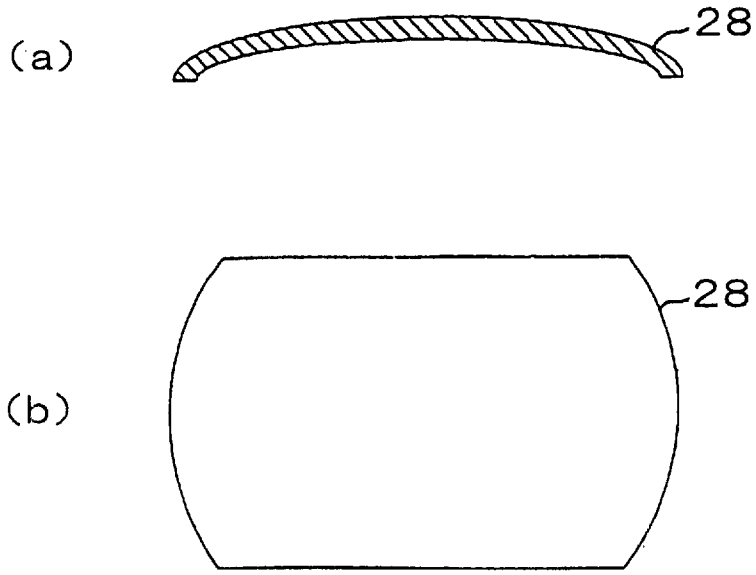
Figure 11:
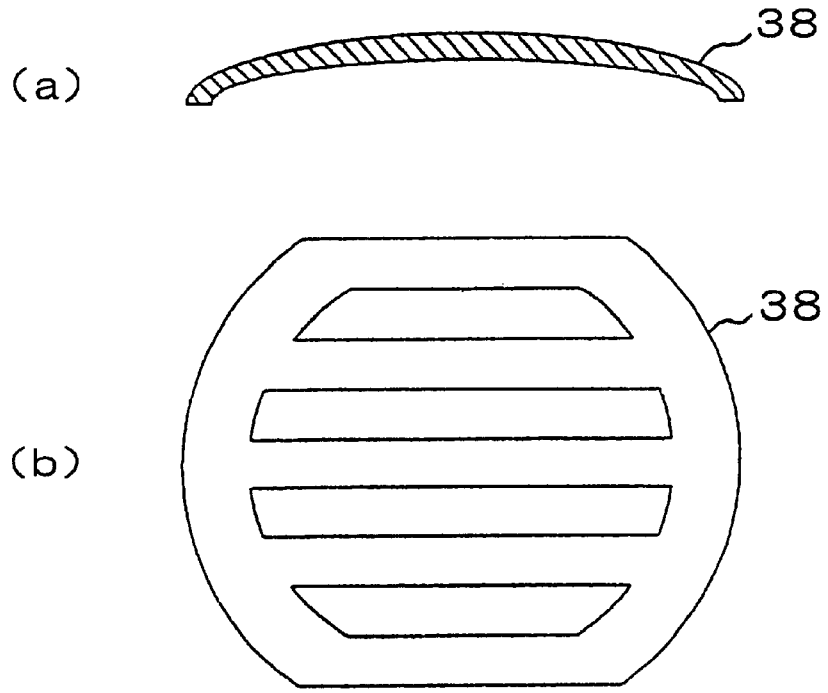

According to the embodiments of the present invention, the shape of the dome type switch constituting the movable contact 8 is not limited to the shape shown in FIGS. 8A and 8B. According to alternative embodiments of a light illuminating type switch having features of the present invention, and corresponding to the specification of the particular electroluminescent sheet used, a movable contact 18 may have an arc-like portion of a dome type switch which is formed in a net-like shape as shown by FIGS. 9A and 9B; or a movable contact 28 may have a shape in which both ends of the dome type switch shown in FIGS. 8A and 8B are cut as shown in FIGS. 10A and 10B; or a movable contact 38 may have a shape in which both ends of the net-like dome type switch shown in FIGS. 9A and 9B are cut as shown by FIGS. 11A and 11B, to thereby achieve excellent click feeling.

Figure 13:
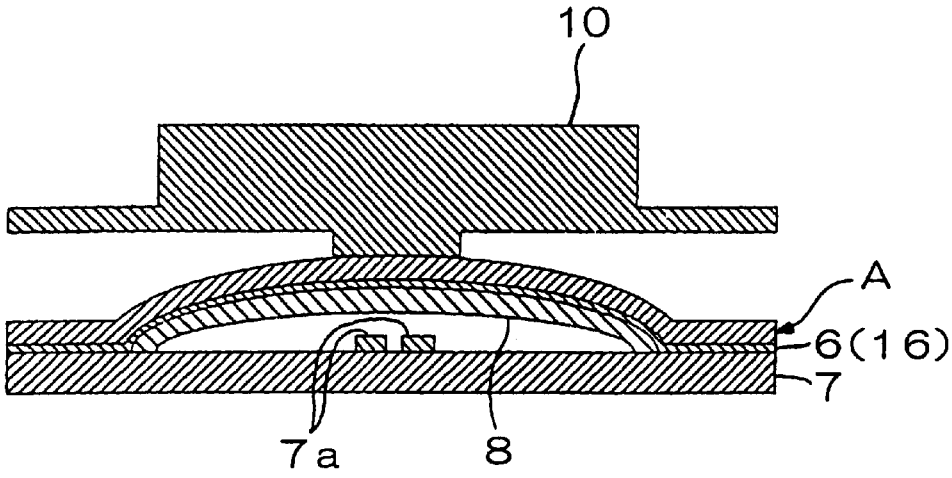
FIG. 13 is a sectional view showing an example in which a key operating pad is provided to the light illuminating type switch according to an embodiment of the invention.

FIG. 13 shows an embodiment according to the present invention in which a key operating pad 10 is arranged for operating ON and OFF the movable contact 8 above the electroluminescent sheet A of the light illuminating type switch. The key operating pad 10 is formed by a material of silicone rubber or the like which is substantially transparent. In the embodiment of the light illuminating type switch shown in FIG. 13, a key operating pad 10 having a large thickness is not necessary to enable the light illuminating type switch to illuminate light uniformly. In addition, by providing such a key operating pad 10, further excellent click feeling can be expected.

Figure 14:
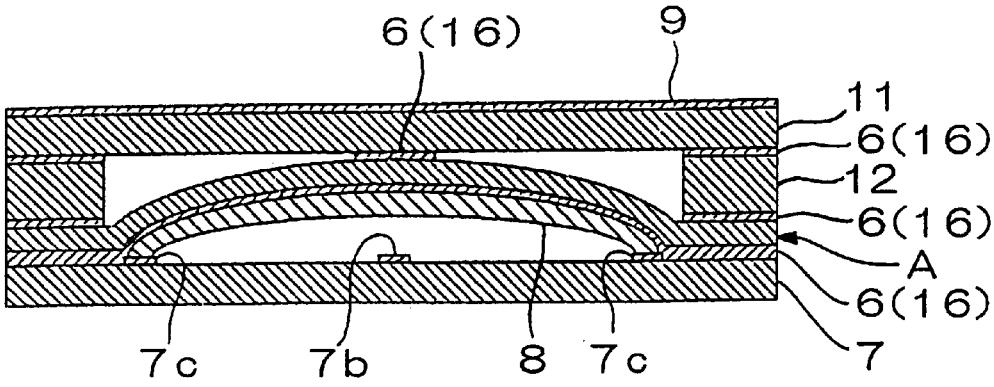
FIG. 14 is a sectional view showing an example in which a key operating pad in a sheet-like shape is provided to a light illuminating type switch according to an embodiment of the invention.
Figure 15:
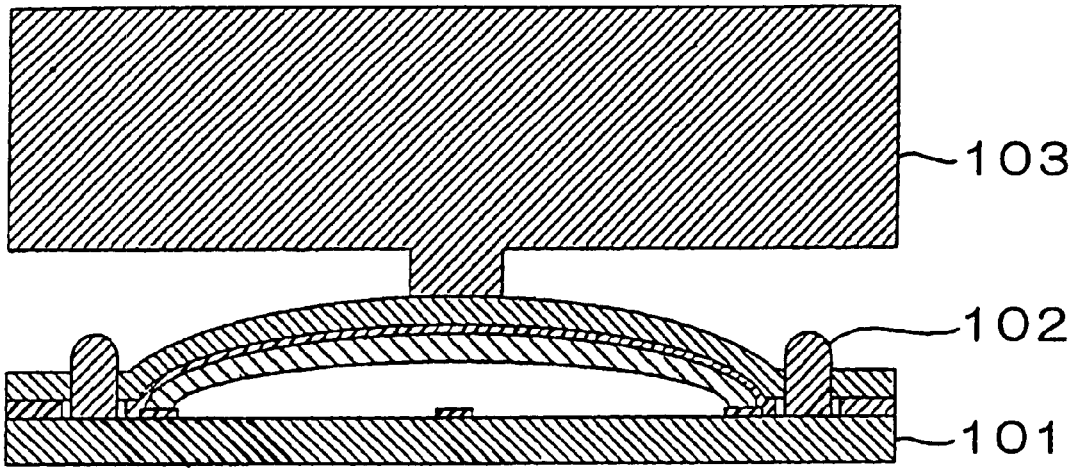
FIG.15 PRIOR ART
FIG. 15 is a sectional view showing a conventional example in which an LED is used as a light source of a light illuminating type switch.

FIG. 14 shows an embodiment according to the present invention in which a sheet-like key operating pad 11 is arranged for operating ON and OFF the movable contact 8 above the electroluminescent sheet A of the light illuminating type switch. Further, according to fixed contacts in the drawing, the fixed contacts are not constituted by a pair of fixed contacts, described above, but are electrically connected by a fixed contact 7*b* below a central portion of the arc-like shape of the movable contact 8 and an edge portion 7*c* of the arc-like shape. According to an aspect of the present invention, the sheet-like key operating pad 11 is provided above the electroluminescent sheet A of the light illuminating type switch via a spacer 12. For example, a sheet-like key operating pad 11 is used, a surface of which is printed with characters or graphic FIG. 9. The embodiment shown in FIG. 14 also uses the electroluminescent light source and, therefore, uniform light luminescence can be achieved without the sheet-like key operating pad 11 having a large thickness; specifically, the sheet-like key operating pad 11 can have a thickness equal to or smaller than 1 mm. Respective portions of the sheet-like key operating pad 11 are attachedly pasted to the spacer 12 using the adhesive material 6 or the sheet 16 attached with the double-sided adhesive material.

Although the above-described embodiments have been shown with the movable contact 8 attachedly pasted by coating the adhesive material 6 or pasting the sheet 16 attached with the double-sided adhesive material to the electroluminescent sheet A, it will be appreciated by those having skill in the art that the electroluminescent sheet A may be attachedly pasted by coating the adhesive material 6 or pasting the sheet 16 attached with the double-sided adhesive material to the movable contact 8.

The present invention can be implemented by the embodiments explained above and achieves the effects described below.

By adopting the constitution of the invention, the movable contact and the electroluminescent sheet are constructed as an integrated structure; that is, there can be achieved complete unitization of the light illuminating type switch including the switch sheet. Further, vibration in driving the electroluminescent sheet is reduced and the switch becomes noiseless.

By adopting the metal material formed in the dome shape for the movable contact, pertinent click feeling can be achieved by a simple structure. When the electroluminescent sheet and the movable contact are attachedly pasted together, such that the adhesive material is interposed therebetween only at a portion of the surface of the movable contact, further excellent click feeling can be achieved.

As an alternative to using the adhesive material, the electroluminescent sheet and the movable contact can be attachedly pasted together by interposing the sheet attached with the double-sided adhesive material therebetween to thereby promote integration of the electroluminescent sheet and the movable contact.

By adopting and combining various shapes of the metal material formed in the dome shape in accordance with the specification of the electroluminescent sheet used, a desired click feeling can be achieved in correspondence with various environments.

By pre-molding the electroluminescent sheet to be attachedly pasted to the movable contact in the shape that conforms to the shape of the movable contact, further excellent click feeling can be achieved.

By constituting a portion of the electroluminescent sheet disposed at the surface portion of the movable contact to omit at least one layer of the luminescent layer, the insulating layer and the rear electrode layer of the electroluminescent sheet, a portion of the electroluminescent sheet which has no influence on light luminescence is subjected to repeated elastic deformation and accordingly, enhanced durability of the electroluminescent sheet can be achieved.

Finally, by arranging the key operating pad above the electroluminescent sheet constituting the light illuminating type switch, the thickness of the switch can be thinned, firm and excellent click feeling can further be achieved, and thinner formation of an electronic device per se adopting the light illuminating type switch can also be achieved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A light illuminating type switch comprising:

a switch sheet having fixed contacts;

a movable contact capable of electrically connecting to the switch sheet by being deformed elastically arranged above the switch sheet; and a flexible electroluminescent sheet attachedly pasted on a surface of the movable contact and conforming to the shape of the movable contact.

2. The light illuminating type switch according to claim 1, wherein the electroluminescent sheet and movable contact are attachedly pasted together by an adhesive agent interposed between the electroluminescent sheet and the surface of the movable contact.

3. The light illuminating type switch according to claim 2, wherein the adhesive agent is interposed between the electroluminescent sheet and only a portion of the surface of the movable contact.

4. The light illuminating type switch according to claim 2, wherein the adhesive agent is interposed between the electroluminescent sheet for 80% or less of an arc-like portion of the surface of the movable contact.

5. The light illuminating type switch according to claim 1, wherein the electroluminescent sheet and the movable contact are attachedly pasted together by a sheet attached with a double-sided adhesive material interposed between the electroluminescent sheet and the surface of the movable contact.

6. The light illuminating type switch according to claim 5, wherein the sheet attached with the double-sided adhesive material is interposed between the electroluminescent sheet and only a portion of the surface of the movable contact.

7. The light illuminating type switch according to claim 5, wherein the sheet attached with a double-sided adhesive material is interposed between the electroluminescent sheet and the surface of the movable contact for 80% or less of an arc-like portion of the surface of the movable contact.

8. The light illuminating type switch according to claim 1, wherein the movable contact is a metal member formed in a dome shape.

9. The light illuminating type switch according to claim 8, wherein the metal member formed in the dome shape is formed in a net-like shape.

10. The light illuminating type switch according to claim 1, wherein the electroluminescent sheet is previously molded or plastically deformed to be formed in a shape that corresponds to a shape of the movable contact.

11. The light illuminating type switch according to claim 1, wherein the electroluminescent sheet is formed by successively laminating a transparent electrode layer, a luminescent layer, an insulating layer and a rear electrode layer on a flexible transparent film and at least one layer of the luminescent layer, the insulating layer and the rear electrode layer is omitted at a portion of the layer disposed above a surface portion of the movable contact.

12. The light illuminating type switch according to claim 1, wherein a key operating pad is arranged above the electroluminescent sheet.

13. The light illuminating type switch according to claim 12, wherein a key operating pad is formed in a sheet-like shape.

* * * * *